US007150436B2

(12) United States Patent
Achleitner et al.

(10) Patent No.: US 7,150,436 B2
(45) Date of Patent: Dec. 19, 2006

(54) METHOD FOR INSTALLING POINTS IN RAILWAY TRACKS AND POINTS FOR CARRYING OUT SAID METHOD

(75) Inventors: Herbert Achleitner, Graz (AT); Karl Schnedl, Grosslobming (AT); Josef Hörtler, Knittelfeld (AT); Gerhard Berliz, Knittelfeld (AT)

(73) Assignees: VAE Eisenbahnsysteme GmbH, Zeltweg (AT); VAE GmbH, Vienna (AT)

( * ) Notice: Subject to any disclaimer, the term of this patent is extended or adjusted under 35 U.S.C. 154(b) by 0 days.

(21) Appl. No.: 10/476,948

(22) PCT Filed: May 7, 2002

(86) PCT No.: PCT/AT02/00140

§ 371 (c)(1),
(2), (4) Date: Nov. 6, 2003

(87) PCT Pub. No.: WO02/090658

PCT Pub. Date: Nov. 14, 2002

(65) Prior Publication Data

US 2004/0135036 A1 Jul. 15, 2004

(30) Foreign Application Priority Data

May 7, 2001 (AT) ..... GM357/2001

(51) Int. Cl.
*E01B 7/00* (2006.01)

(52) U.S. Cl. ..... 246/415 R

(58) Field of Classification Search ..... 246/415 R, 246/435 R, 442, 448, 449, 452, 455, 450, 246/451; 238/8
See application file for complete search history.

(56) References Cited

U.S. PATENT DOCUMENTS 3,065,004 A * 11/1962 Laich ..... 403/278
3,784,134 A 1/1974 Claus et al.
4,534,527 A 8/1985 van Eyken et al.
5,620,156 A 4/1997 Berggren et al.
6,550,571 B1 * 4/2003 Kimura et al. ..... 181/200

FOREIGN PATENT DOCUMENTS

CH 583 822 1/1977
EP 0 108 168 A1 5/1984

(Continued)

*Primary Examiner*—Mark T. Le
(74) *Attorney, Agent, or Firm*—Chapman and Cutler LLP

(57) ABSTRACT

A method for installing railway switches in tracks is characterized in that the switch completely preassembled in functional units (1, 2, 7, 18) is transferred onto a transport vehicle, and that the tongue region, the rail interspace region and the core region including preassembled sleepers (6, 18), the movable switch parts such as, e.g., the tongue device and the safety devices are lowered on the installation site in the preassembled state and connected with the adjoining rails, whereupon the switch is ballasted and the track ballast is packed, the connection ducts for the switch mechanism and the switch safety devices are connected and the switch is put into operation. In the railway switch capable of being transported in the preassembled state, the actuating drives are designed as hydraulic actuators (3, 4, 5). The hydraulic lines (6) for the connection of the actuating drives are elastically fixed to the sleepers (18). The actuating drives (3, 4, 5) are connected to the movable switch parts such as, e.g., tongues (2) in a manner pivotable about an axis extending in the longitudinal direction of the rails with elastic connection elements and/or crowned bearings (8, 9) being interposed.

46 Claims, 9 Drawing Sheets

FOREIGN PATENT DOCUMENTS

| | | | |
|---|---|---|---|
| EP | 0 486 456 A1 | 5/1992 | |
| EP | 0 617 169 B1 | 9/1994 | |
| EP | 0 715 580 B1 | 6/1996 | |
| WO | WO 98/54041 | * | 12/1998 |
| WO | WO 99/20511 | * | 4/1999 |

* cited by examiner

METHOD FOR INSTALLING POINTS IN RAILWAY TRACKS AND POINTS FOR CARRYING OUT SAID METHOD

The invention relates to a method for installing railway switches in tracks as well as a railway switch capable of being transported in the preassembled state and including sleepers, a tongue region, a rail interspace region and a core region, a device for movable switch parts such as, e.g. tongues, actuating drives and control devices for carrying out said method.

The delivery of railway switches, as a rule, occurs after preassembly at the manufacturing plant with a complete functional check being effected after such preassembly. Following said preassembly, the switch is again completely disassembled and transported to the place of installation. The new assembly and new installation and alignment of the switch involve relatively long mounting times and hence relatively long track closures. Switches having relatively large radii of curvature, i.e. switches that can be passed at relatively high speeds, require a plurality of switching planes. That plurality of switching planes call for a relatively intense force transmission, with different switching paths in different switching planes having to be taken into account. Conventional solutions in railway switch construction have proposed connecting rod assemblies or single drives for the individual switching planes. In the event of connecting rod assemblies only the maximum actuation force can be realized every time, whereby changes in the length of the connecting rod assembly due to temperature deviations and sleeper migration may cause tensions within the rod assembly, thus resulting in an increased wear as well as error functions during the switching procedure. Usual connecting rod assemblies are, therefore, limited to a maximum of four switching planes. No such limitations apply in the case of single drives. Due to the required plurality of driving units, a higher input in terms of control engineering is, however, required.

After the installation of a switch in the track, the substructure of the switch has to be built, machine packing being required also in the region of the switch. The enhanced ballast compaction attainable by machine packing extends the intervals between packing procedures required during operation and hence also the maintenance costs involved.

The invention aims to provide a method for installing railway switches in tracks, by which installation times can be minimized and long track closures can be avoided. To solve this object, the installation method according to the invention is essentially characterized in that the switch completely preassembled in functional units is transferred onto a transport vehicle, and that the core region including preassembled sleepers, the tongue device and the safety devices are lowered on the installation site in the preassembled state and connected with the adjoining rails, whereupon the switch is ballasted and the track ballast is packed, the connection ducts for the switch mechanism and the switch safety devices are connected and the switch is put into operation. Due to the fact that a fully premounted and completely assembled railway switch can be transported on site in a manner ready to plug in—as one might say, it is feasible to put the switch into operation after linkage with the track immediately upon laying and packing without any further adjustment of the connections and safety devices such that extended track closures will be avoided. To this end, the preassembled switch after complete primary mounting at the manufacturing plant is transferred onto special transport cars and transported on site, whereupon machine laying and packing are effected. In this respect, it is advantageously proceeded in a manner that the core region and/or the rail interspace region for transport purposes are tilted out of the rail running plane and transported in the tilted state. A subdivision into a plurality of functional units such as, for instance, the core region, the tongue device and the rail interspace region is merely required with relatively long railway switches in order to enable transportation to the place of installation also along winding tracks. In the main, the system comprised of sleeper, rail, switching mechanism and safety device is, however, deformed from the operating position during transportation, and it will, therefore, be necessary to provide an accordingly elastic deformability by the dead weight and the action of force during the transport and packing procedures. With the subdivided delivery in separated functional units, it is advantageously proceeded for the definitive assembly in respect to the core region and the tongue device, that the rail interspace region and/or the core region after tilting are lowered in the vertical direction and connected with the tongue device. Final mounting is limited to linking with the track, wherein a provisional linkage may be provided during the packing procedure and the definitive, final linkage will be realized after completion of the packing procedure.

The construction necessary to carry out this method has to ensure sufficient resilience in two planes in any junction to a tongue, stock rail or sleeper in order to safeguard that immediately after the packing procedure the switch will assume an operating position in which it will be merely required to link the connections for the safety devices and the switching device with the finished railway switch. To this end, the railway switch according to the invention, which is capable of being transported in the preassembled state, is essentially characterized in that the actuating drives are designed as hydraulic actuators, the hydraulic lines for the connection of the actuating drives are elastically fixed to the sleepers, and the actuating drives are connected to the movable switch parts such as, e.g., tongues in a manner pivotable about an axis extending in the longitudinal direction of the rails with elastic connection elements and/or crowned bearings being interposed. By using hydraulic actuators, sensitive connecting rod assemblies can be obviated, thus not only enabling the provision of a plurality of prefinished switching planes, but also substantially reducing any risk of damage occurring during packing. To this end, the hydraulic lines for the connection of the actuating drives are elastically fixed to the sleepers such that any distortions and deflections during transportation, of the switch parts connected with the sleepers will not affect the hydraulic lines. By additionally connecting the actuating drives to the tongues in a manner pivotable about an axis extending in the longitudinal direction of the rails by interposing elastic connection elements and/or crowned bearings, adequate deformations during transportation will be allowed while ensuring an operationally safe position ready for operation to be assumed immediately after the packing procedure, in this context, the configuration according to the invention advantageously is devised such that the driving means such as, e.g. pump, motor and optionally pressure accumulator are elastically fixed within a trough sleeper. Overall, such a configuration safeguards an elastic connection of the actuating device to the tongue, which, during operation, ensures the defined adjustment required without providing any further elastic degrees of freedom, the actuating device itself being advantageously elastically suspended vertically within the trough sleeper. To this end, the configuration advantageously is devised such that the actuating drives are received in cheeks or lateral stops of the trough sleeper so as to be secured against any displacement in the longitudinal direction of the trough sleeper, the cheeks or lateral stops of the trough sleeper being preferably designed to be crowned and the actuating drives between the cheeks or crowned stops being preferably mounted so as to be pivotable about an axis extending in the longitudinal direction of the rails.

In a similar manner, compensation rods and control means may be elastically guided vertically and coupled to the tongue foot. In this context, the configuration is advantageously devised such that the testing rods are connected to the tongues so as to be pivotable about an axis extending in the longitudinal direction of the rails and displaceable in the vertical direction with elastic connection elements and/or crowned bearings being interposed, said testing rods advantageously acting upon a vertical pin connected with the tongues or the connection element of the actuating drive on the tongues, with springs acting in the vertical direction being interposed. The respective elastic degrees of freedom are in each case chosen such that they take into account any possible bending or distortion occurring during transportation, whereas, however, in operation the respective elasticity is minimized and restricted to the usual bearing play in the direction of the switching paths to be precisely observed.

In order to prevent any damage to the individual connection parts and, in particular, parts overlapping the sleepers, the configuration is advantageously devised such that structural components extending over a plurality of sleepers, such as, e.g., hydraulic lines, are encompassed by a roof-shaped or U-shaped covering comprised of several segments telescopically displaceable one within the other. Such covering parts which are vertically displaceable within one another and elastically fastened to the sleepers are able to balance out differences in level of the sleepers caused during transportation and packing. The structural width of the trough sleeper may be chosen to correspond with the usual structural dimension of a concrete sleeper such that no projecting built-in parts likely to impede or complicate the packing procedure will be present.

During transportation and packing, the railway switch fixed to the sleepers is to be regarded as an elastic formation to be brought into its exact operating position only upon completion of the packing procedure. Consequently, all coupling sites to rail parts exhibit an elasticity that takes into account stresses caused during transportation, the exact operating position being assumed immediately after the packing procedure. Besides the hydraulic lines mentioned, structural components extending over a plurality of sleepers naturally also comprise sensor cables arranged in the track center, the covering definitely reaching as far as to that trough sleeper via which such cables and hydraulic lines are conducted to their connections and run into a control box arranged outside of the track region.

It was, in fact, demonstrated in practice by way of a prototype that the adjustments made by the manufacturer in regard to the respectively demanded elasticities of the connection elements were fully retained such that operation in terms of functioning signals could be started immediately after the installation of the control box and its connection to the safeguarding plant of the signal tower, without requiring any further adjustments to be carried out subsequently at the ready laid tongue device.

In the following, the invention will be explained in more detail by way of exemplary embodiments schematically illustrated in the drawing. Therein, FIG. 1 is a top view on a mounted switching arrangement including a driving station and two further switching planes;

Figure 1:
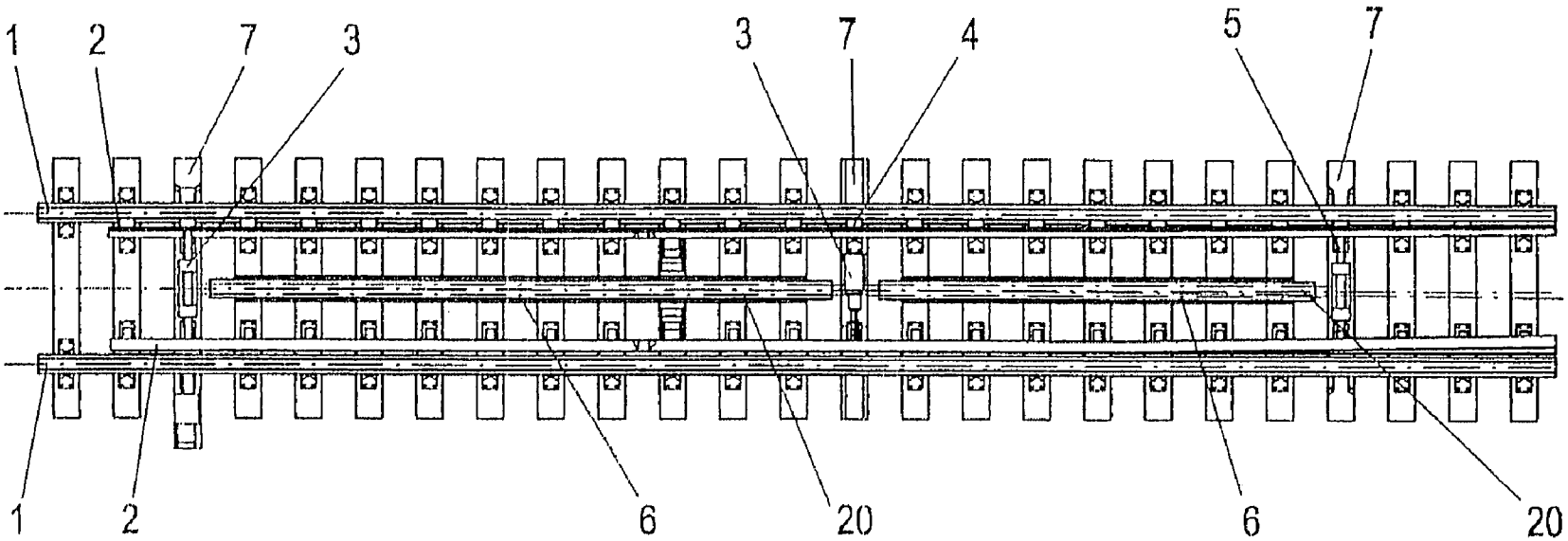
Figure 2:
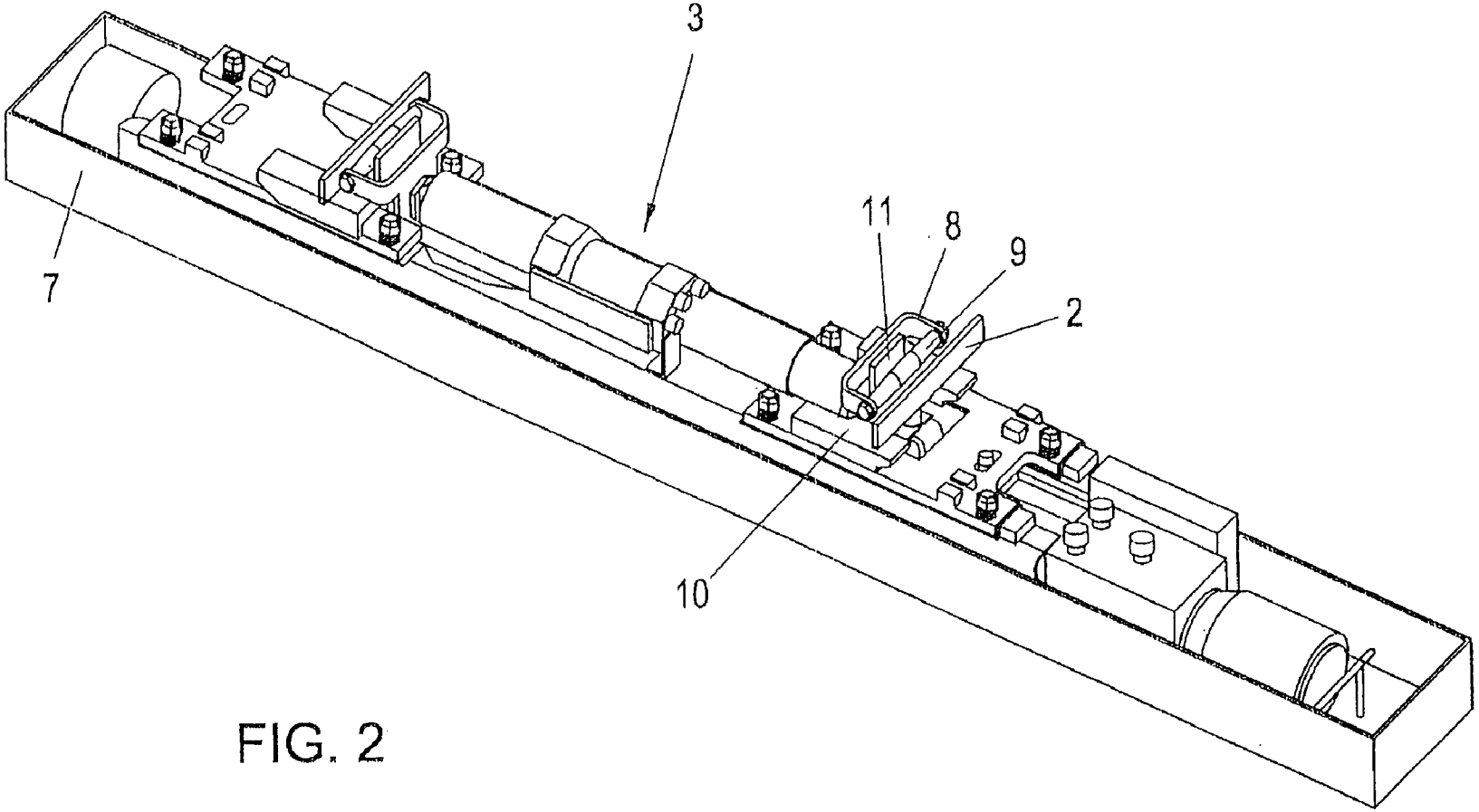
FIG. 2 depicts the hydraulic switch actuator and lock as positioned within a trough sleeper.

FIG. 1 is a top view on a ready mounted switching arrangement including a stock rail 1 and a tongue rail 2. The hydraulic driving station is denoted by 3, wherein hydraulic units 4 and 5, which are connected with each other and with the hydraulic switch actuator 3 by means of hydraulic lines 6, are provided in two further switching planes. As is apparent from FIG. 1, no projecting built-in parts that might impede or complicate the packing procedure are present, wherefore trough sleepers 7 whose structural widths correspond to the usual structural dimensions of concrete sleepers are employed. FIG. 2 depicts the switch actuator as positioned within such a trough sleeper. The hydraulic switch actuator is again denoted by 3, wherein the transmission of the forces necessary for the displacement of the switch tongue is effected via elastic connection elements and/or crowned bearings. To this end, a fork-shaped bracket 8 is provided, in which a pin 9 having a cambered jacket tube is arranged. The tongue rail indicated at 2, which is guided on a slide chair 10, is connected with a cranked strap 11 which engages in the free space between the pin 9 and the bracket 8 in order to transmit the switching forces. Elastic connection elements may be arranged therebetween, enabling a play-free force transmission and, at the same time, a slight pivotability of the actuating drive relative to the tongue about an axis extending in the longitudinal direction of the rails and/or a plane extending parallel with the plane of the rails. Said pivotability takes into account that deformations of the preassembled switch during transportation as well as during the packing procedure cannot be prevented.

Figure 3:
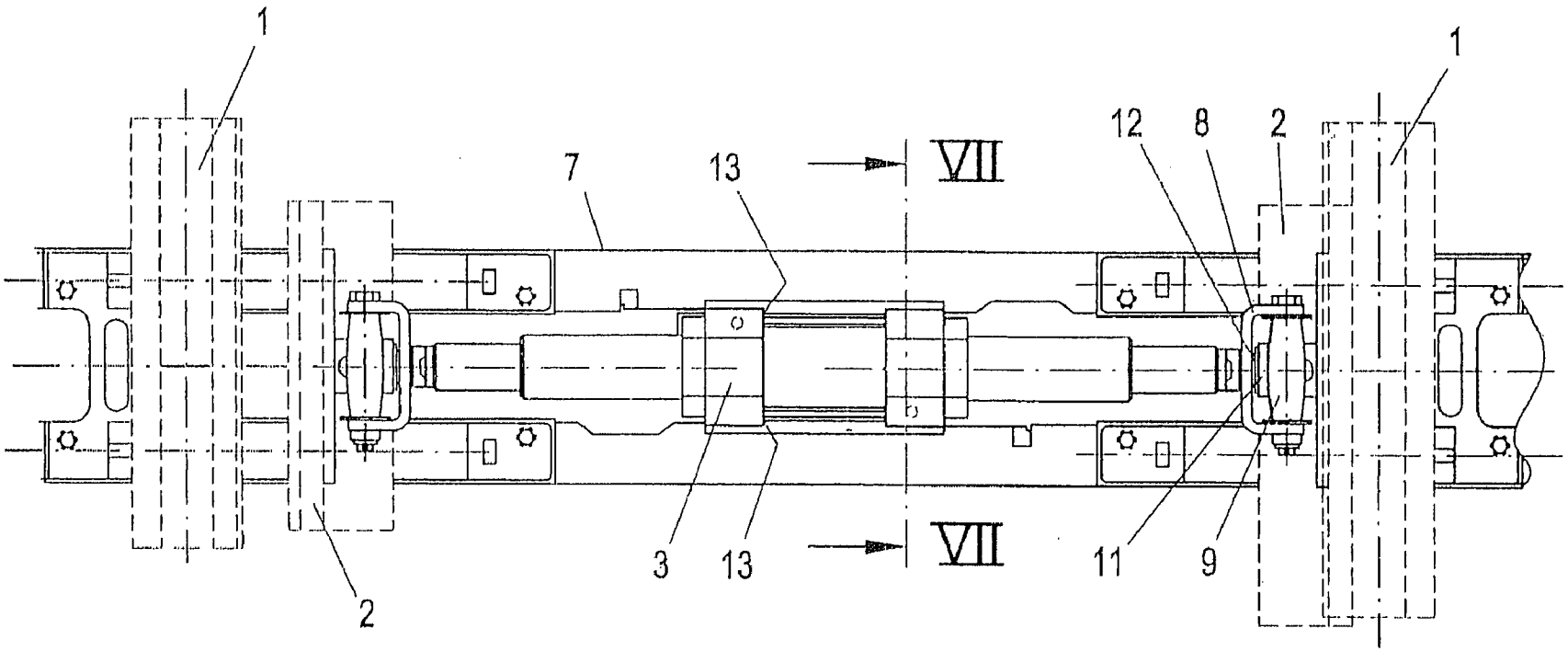
FIG. 3 is a top view on a switching unit.

FIG. 3 is a top view on the trough sleeper incorporating a switch actuator, again illustrating the elastic connection device of the actuating drive 3 to the switch tongue 2. From the top view, also a resilient thrust pad 12 having a cranked thrust face is apparent, which enters into effect as the switch tongue 2 is being displaced into the abutment position on the strap 11, causing the tongue 2 to be elastically pressed at the stock rail 1 and the pin 9 to be lifted from, and getting out of abutment on, the strap 11.

Figure 7:
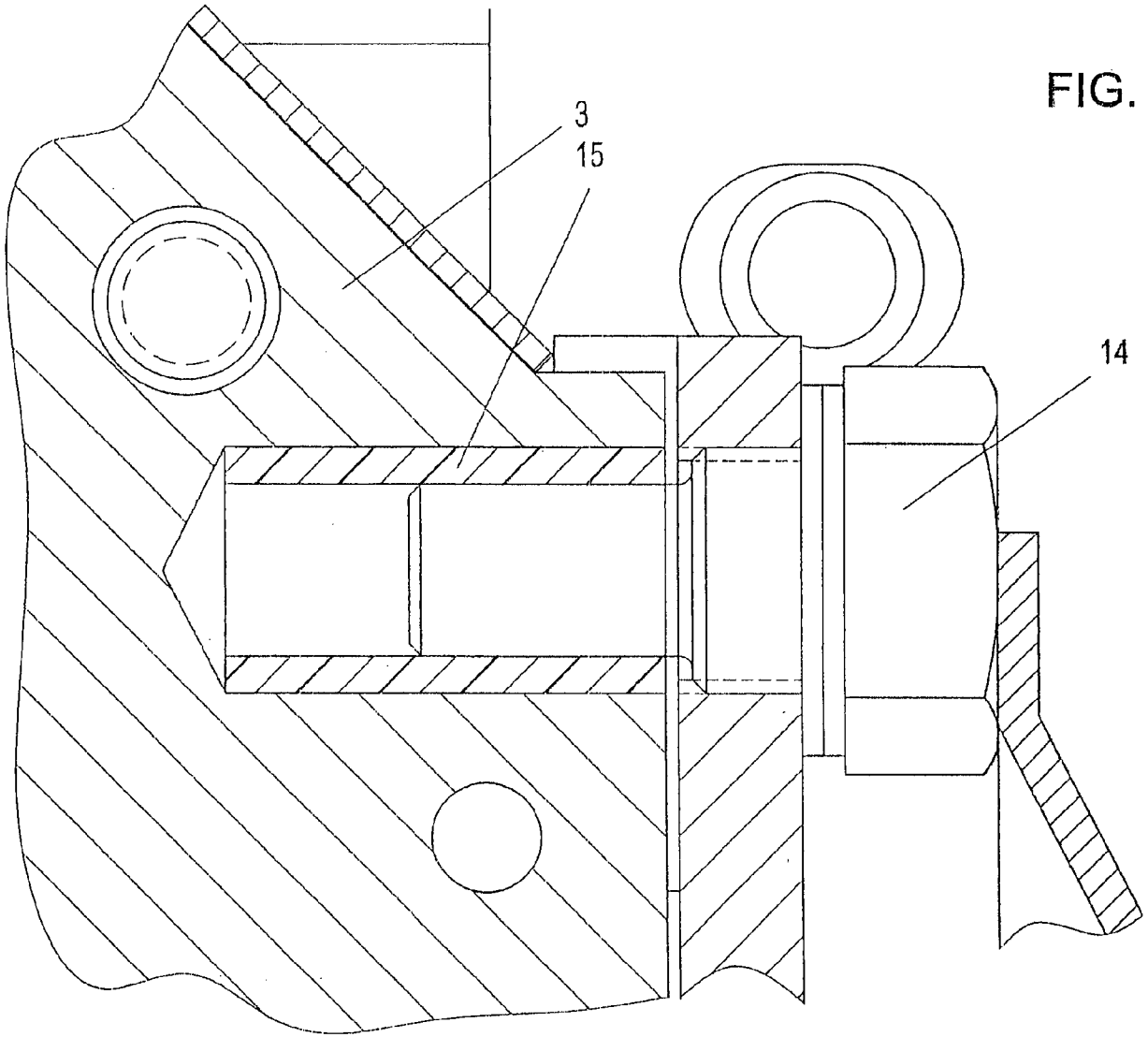
FIG. 7 is a sectional representation along line VII—VII of FIG. 3.

The actuating device 3 is elastically suspended in the vertical direction within the trough sleeper 7 and to this end is received in cheeks or lateral stops 13 of the trough sleeper 7 so as to be secured against displacement in the longitudinal sense of the trough sleeper 7. The cheeks or lateral stops 13 of the trough sleeper 7 may be crowned such that the actuating device 3 between the cheeks or crowned stops 13 is mounted so as to be pivotable about an axis extending in the longitudinal direction of the rails. The actuating device 3 is connected with the trough sleeper 7 via fastening screws 14, as is more clearly apparent from the sectional illustration according to FIG. 7. The screw 14 is received in an elastic bush 15 so as to ensure the elastic movability of the actuating device 3 relative to the trough sleeper 7.

Figure 4:
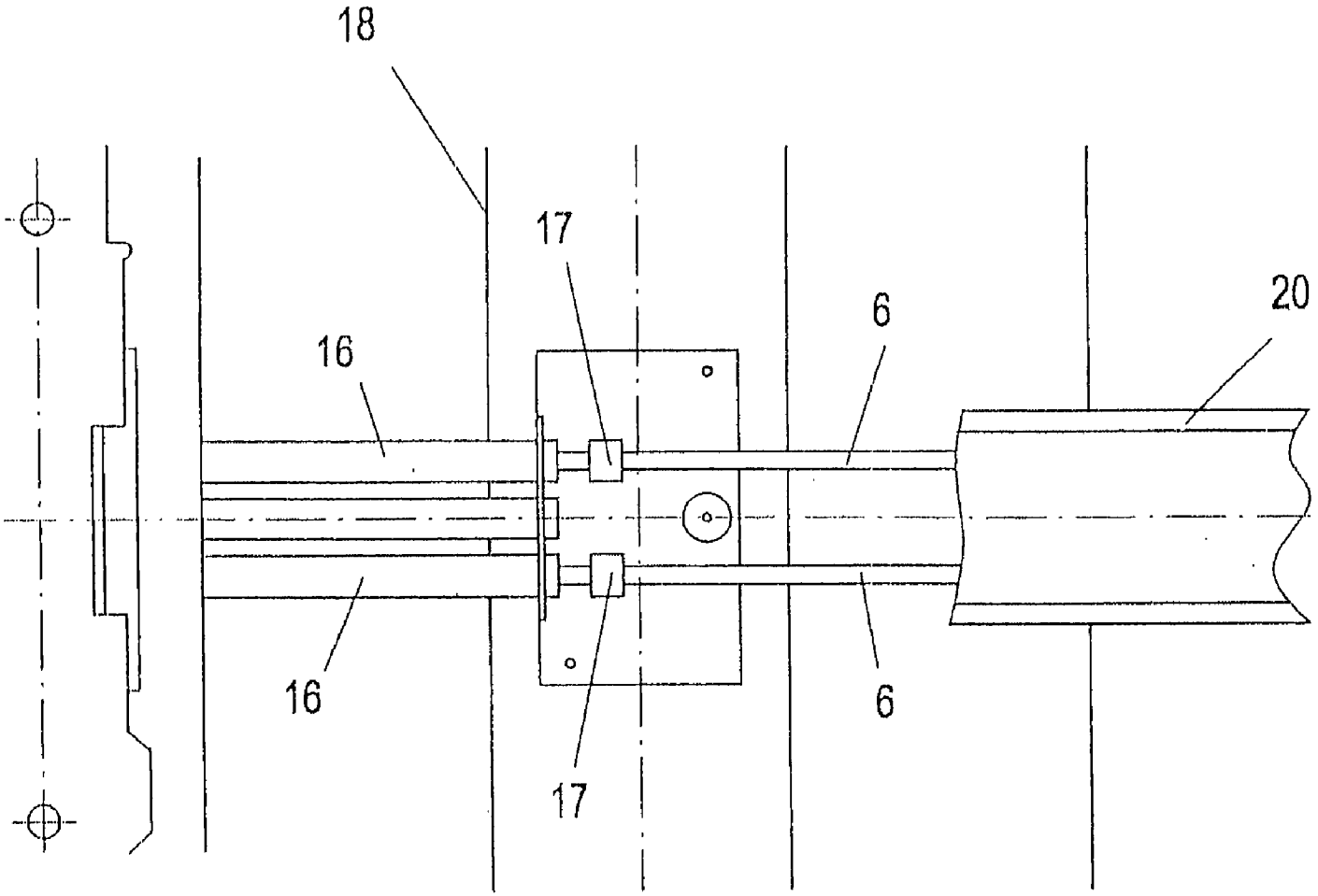
FIG. 4 shows the connection duct between the switching units.
Figure 5:
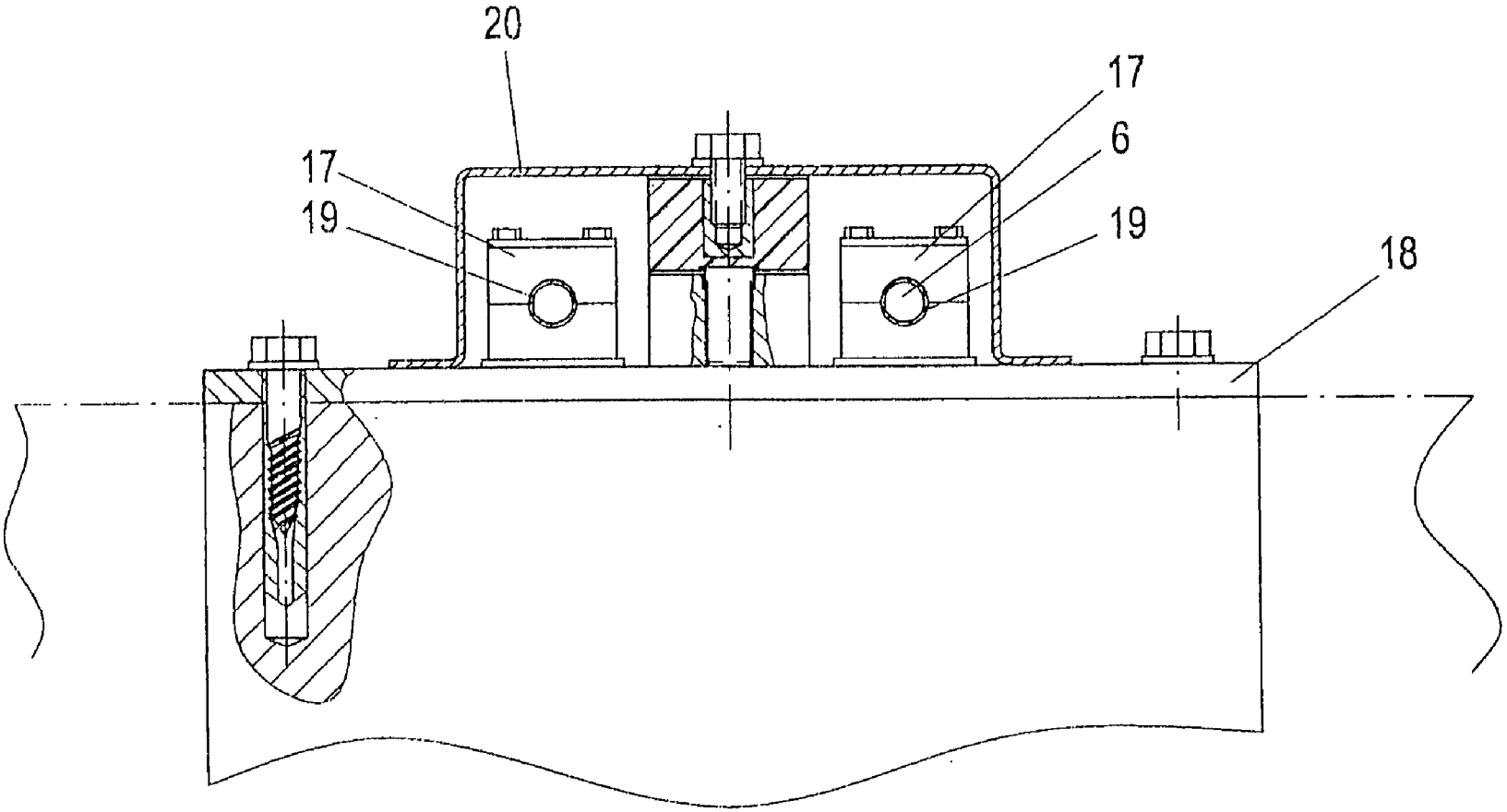
FIG. 5 shows the fixation to the sleeper, of the hydraulic lines plus covering.
Figure 6:
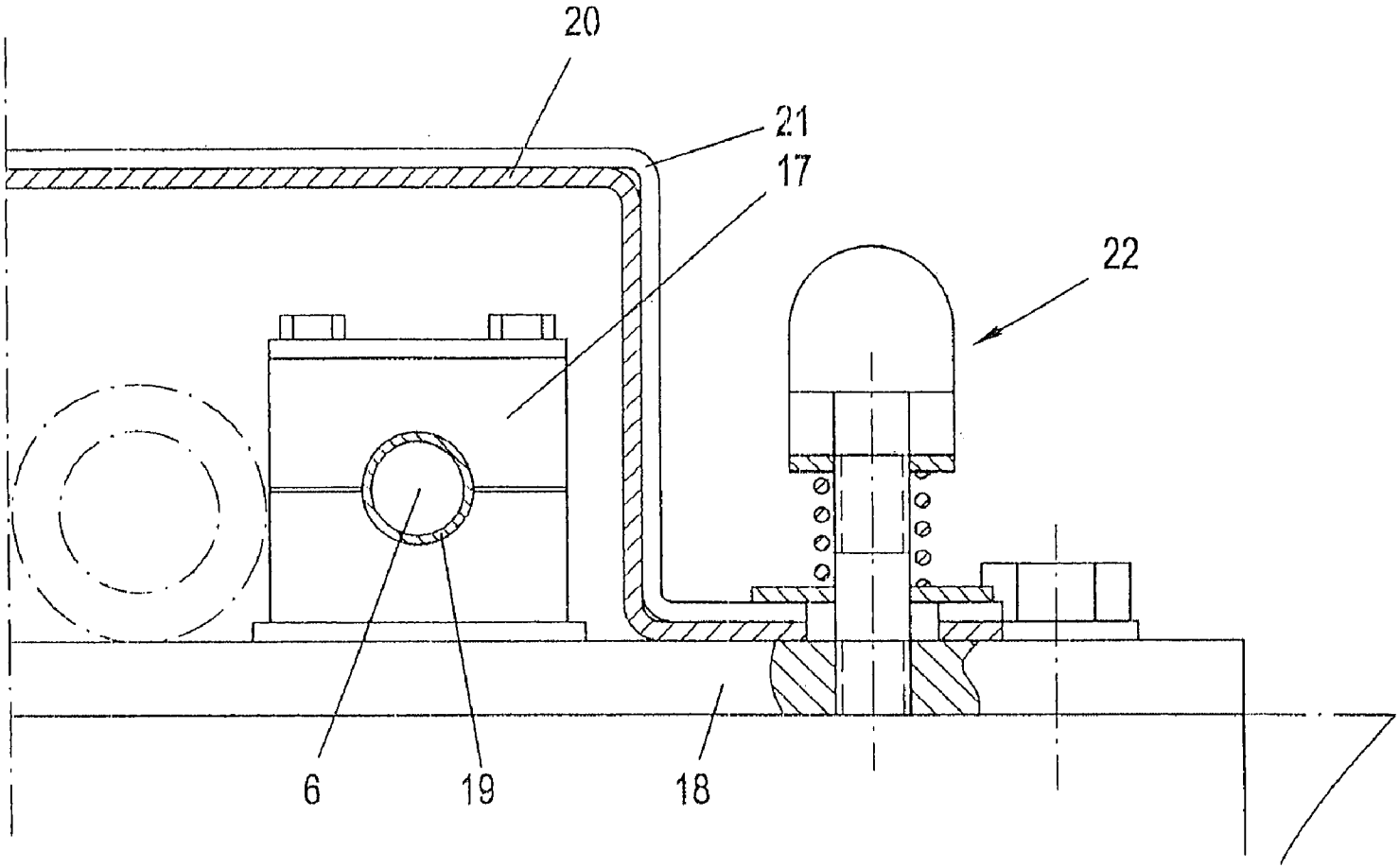
FIG. 6 shows the fixation to a sleeper in the overlap region.

FIG. 4 illustrates the hydraulic connection ducts between the individual actuating drives arranged to be offset in the longitudinal direction of the rails. The hydraulic lines 6 are surrounded by protective hoses 16 and fixed to a sleeper 18 by means of pipe clips 17. According to the invention, the fixation in this case is realized elastically by surrounding the hydraulic line 6 by an elastic shell 19 as illustrated in FIG. 5, so as to enable a relative movement between the hydraulic line 6 and the pipe clip 17. Any possible deflections and distortions caused during transportation will thereby be taken into account. In order to prevent any damage to the hydraulic lines and other structural components extending over a plurality of sleepers, the hydraulic lines are lapped over by coverings 20. The coverings 20 are comprised of several telescopically displaceable segments so as to enable the balancing out of any differences in level eventually caused at the sleepers during transportation and packing. FIG. 6 depicts the region overlapped by two coverings 20 and 21, the resilient fixation 22 of the covering parts 20 and 21 on the sleeper 18 allowing for the pivotability of the covering parts 20 and 21 relative to each other in a vertical plane extending in the longitudinal direction of the rails.

Figure 8:
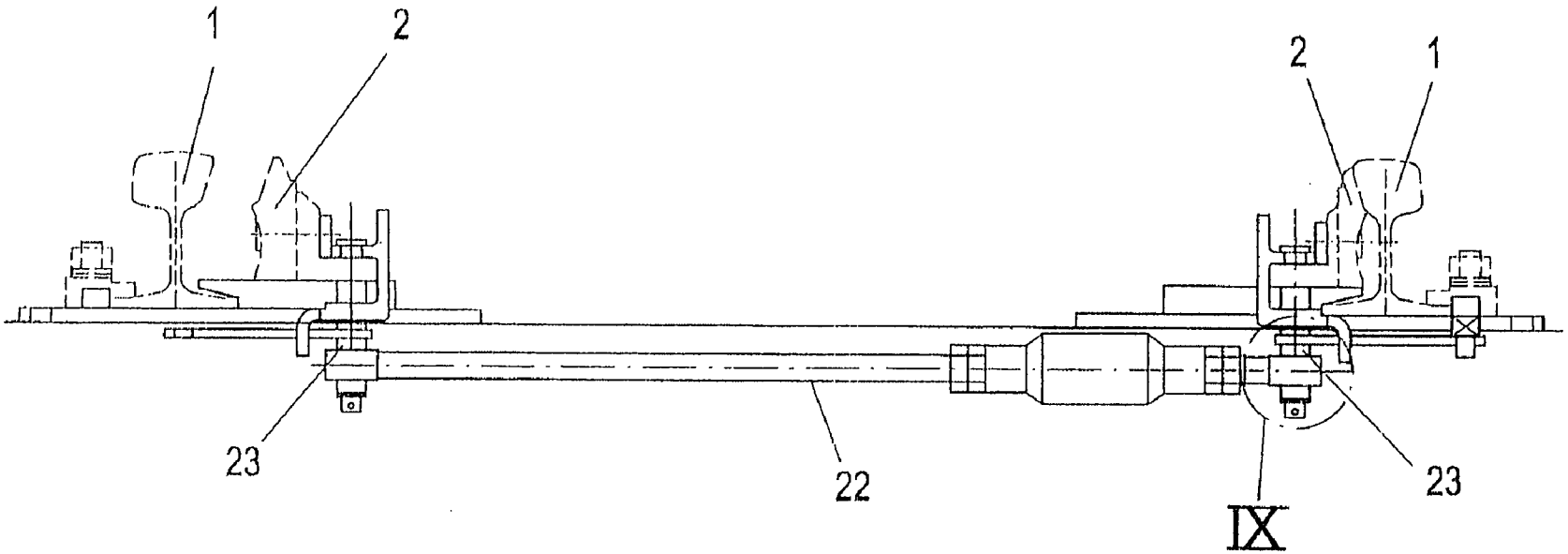
FIG. 8 illustrates the installed position of a testing rod without the switch actuator represented in FIG. 2.
Figure 9:
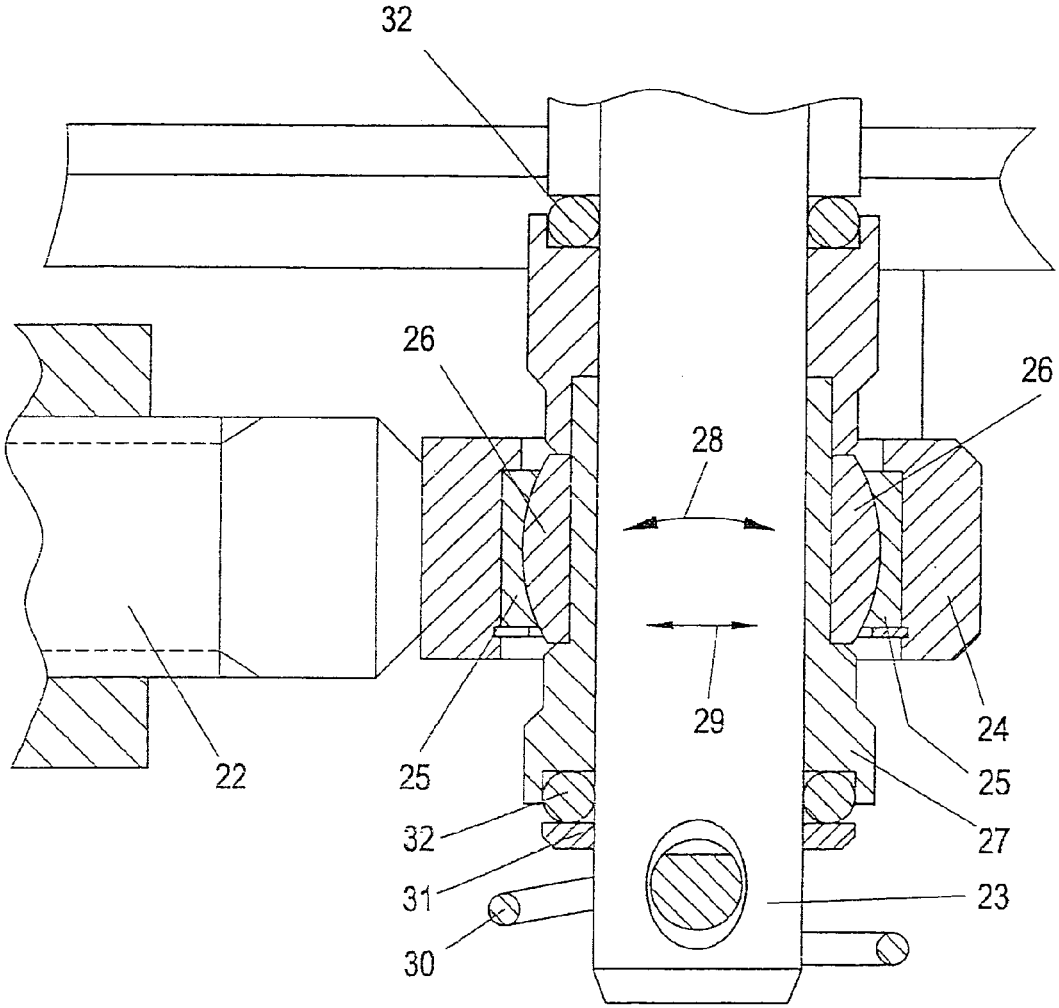
FIG. 9 illustrates a detail of FIG. 8 on an enlarged scale.

From FIGS. 8 and 9, the arrangement of a testing rod 22 is apparent, which is connected with the tongue rail 2 via a pin 23 so as to form a connecting rod assembly. The detail IX of this connection is illustrated in section in FIG. 9. The testing rod 22 is connected with a bearing eye 24 whose concavely curved bearing shell 25 embraces a crowned bearing part 26 of a sleeve 27 connected with the pin 23. That mounting ensures the pivotability in the sense of double arrow 28 without changing the freedom of play in the sense of double arrow 29, which is required for the operating safety. The sleeve 27 is supported in the vertical direction via a spring 30, the spring plate being denoted by 31 and O-rings 32 being provided as sealing elements or elastic connection elements.

The invention claimed is:

1. A railway switch capable of being transported in a preassembled state, comprising sleepers, a rail interspace region, a core region, a tongue device, actuating drives, and control means, wherein the actuating drives are hydraulic actuators, hydraulic lines for connection of the actuating drives are elastically fixed to the sleepers, the actuating drives are connected to movable switch parts in a manner pivotable about an axis extending in a longitudinal direction of rails with elastic connection elements or crowned bearings being interposed, and structural components extending over a plurality of sleepers are encompassed by a covering comprised of several segments telescopically displaceable one within another.

2. A railway switch capable of being transported in the preassembled state and including sleepers, a rail interspace region and a core region, a tongue device, actuating drives and control means, wherein the actuating drives are designed as hydraulic actuators, hydraulic lines for connection of the actuating drives are elastically fixed to the sleepers, the actuating drives are connected to movable switch parts, in a manner pivotable about an axis extending in a longitudinal direction of rails with elastic connection elements and crowned bearings being interposed, and structural components extending over a plurality of sleepers are encompassed by a covering comprised of several segments telescopically displaceable one within another.

3. A railway switch according to claim 1, wherein driving means are elastically fixed within a trough sleeper.

4. A railway switch according to claim 2, wherein driving means are elastically fixed within a trough sleeper.

5. A railway switch according to claim 1, wherein testing rods are connected with the movable switch parts so as to be pivotable about an axis extending in the longitudinal direction of the rails and displaceable in a vertical direction with elastic connection elements or crowned bearings being interposed.

6. A railway switch according to claim 2, wherein testing rods are connected with the movable switch parts so as to be pivotable about an axis extending in the longitudinal direction of the rails and displaceable in a vertical direction with elastic connection elements or crowned bearings being interposed.

7. A railway switch according to claim 3, wherein testing rods are connected with the movable switch parts so as to be pivotable about an axis extending in the longitudinal direction of the rails and displaceable in a vertical direction with elastic connection elements or crowned bearings being interposed.

8. A railway switch according to claim 4, wherein testing rods are connected with the movable switch parts so as to be pivotable about an axis extending in the longitudinal direction of the rails and displaceable in a vertical direction with elastic connection elements or crowned bearings being interposed.

9. A railway switch according to claim 1, wherein testing rods are connected with the movable switch parts so as to be pivotable about an axis extending in the longitudinal direction of the rails and displaceable in a vertical direction with elastic connection elements and crowned bearings being interposed.

10. A railway switch according to claim 2, wherein testing rods are connected with the movable switch parts so as to be pivotable about an axis extending in the longitudinal direction of the rails and displaceable in a vertical direction with elastic connection elements and crowned bearings being interposed.

11. A railway switch according to claim 3, wherein testing rods are connected with the movable switch parts so as to be pivotable about an axis extending in the longitudinal direction of the rails and displaceable in a vertical direction with elastic connection elements and crowned bearings being interposed.

12. A railway switch according to claim 4, wherein testing rods are connected with the movable switch parts so as to be pivotable about an axis extending in the longitudinal direction of the rails and displaceable in a vertical direction with elastic connection elements and crowned bearings being interposed.

13. A railway switch according to claim 5, wherein the testing rods act upon a vertical pin connected with the movable switch parts or a connection element of the actuating drive on the movable switch parts, with springs acting in a vertical direction being interposed.

14. A railway switch according to claim 6, wherein the testing rods act upon a vertical pin connected with the movable switch parts or a connection element of the actuating drive on the movable switch parts, with springs acting in a vertical direction being interposed.

15. A railway switch according to claim 7, wherein the testing rods act upon a vertical pin connected with the movable switch parts or a connection element of the actuating drive on the movable switch parts, with springs acting in a vertical direction being interposed.

16. A railway switch according to claim 8, wherein the testing rods act upon a vertical pin connected with the movable switch parts or a connection element of the actuating drive on the movable switch parts, with springs acting in a vertical direction being interposed.

17. A railway switch according to claim 9, wherein the testing rods act upon a vertical pin connected with the movable switch parts or a connection element of the actuating drive on the movable switch parts, with springs acting in a vertical direction being interposed.

18. A railway switch according to claim 10, wherein the testing rods act upon a vertical pin connected with the movable switch parts or a connection element of the actuating drive on the movable switch parts, with springs acting in a vertical direction being interposed.

19. A railway switch according to claim 11, wherein the testing rods act upon a vertical pin connected with the movable switch parts or a connection element of the actuating drive on the movable switch pans, with springs acting in a vertical direction being interposed.

20. A railway switch according to claim 12, wherein the testing rods act upon a vertical pin connected with the movable switch parts or a connection element of the actuating drive on the movable switch parts, with springs acting in a vertical direction being interposed.

21. A railway switch according to claim 1, wherein the actuating drives are received in cheeks or lateral stops of a trough sleeper so as to be secured against displacement in a longitudinal direction of the trough sleeper.

22. A railway switch according to claim 2, wherein the actuating drives are received in cheeks or lateral stops of a trough sleeper so as to be secured against displacement in a longitudinal direction of the trough sleeper.

23. A railway switch according to claim 3, wherein the actuating drives are received in cheeks or lateral stops of a trough sleeper so as to be secured against displacement in a longitudinal direction of the trough sleeper.

24. A railway switch according to claim 4, wherein the actuating drives are received in cheeks or lateral stops of a trough sleeper so as to be secured against displacement in a longitudinal direction of the trough sleeper.

25. A railway switch according to claim 5, wherein the actuating drives are received in cheeks or lateral stops of a trough sleeper so as to be secured against displacement in a longitudinal direction of the trough sleeper.

26. A railway switch according to claim 6, wherein the actuating drives are received in cheeks or lateral stops of a trough sleeper so as to be secured against displacement in a longitudinal direction of the trough sleeper.

27. A railway switch according to claim 9, wherein the actuating drives are received in cheeks or lateral stops of a trough sleeper so as to be secured against displacement in a longitudinal direction of the trough sleeper.

28. A railway switch according to claim 10, wherein the actuating drives are received in cheeks or lateral stops of a trough sleeper so as to be secured against displacement in a longitudinal direction of the trough sleeper.

29. A railway switch according to claim 13, wherein the actuating drives are received in cheeks or lateral stops of a trough sleeper so as to be secured against displacement in a longitudinal direction of the trough sleeper.

30. A railway switch according to claim 14, wherein the actuating drives are received in cheeks or lateral stops of a trough sleeper so as to be secured against displacement in a longitudinal direction of the trough sleeper.

31. A railway switch according to claim 17, wherein the actuating drives are received in cheeks or lateral stops of a trough sleeper so as to be secured against displacement in a longitudinal direction of the trough sleeper.

32. A railway switch according to claim 18, wherein the actuating drives are received in cheeks or lateral stops of a trough sleeper so as to be secured against displacement in a longitudinal direction of the trough sleeper.

33. A railway switch according to claim 1, wherein the movable switch parts are tongues.

34. A railway switch according to claim 2, wherein the movable switch parts are tongues.

35. A railway switch according to claim 1 wherein the covering is roof-shaped or U-shaped.

36. A railway switch according to claim 2 wherein the covering is roof-shaped or U-shaped.

37. A method for installing in railway tracks a railway switch capable of being transported in a preassembled state, comprising sleepers, a rail interspace region, a core region, a tongue device, actuating drives, and control means, wherein the actuating drives are hydraulic actuators, hydraulic lines for connection of the actuating drives are elastically fixed to the sleepers, and the actuating drives are connected to movable switch parts in a manner pivotable about an axis extending in a longitudinal direction of rails with elastic connection elements or crowned bearings being interposed, comprising the steps of completely preassembling the railway switch in functional units;

transferring the switch onto a transport vehicle to an installation site;

lowering the tongue region, the rail interspace region and the core region including preassembled sleepers, the movable switch parts, and safety devices on the installation site in the preassembled state, and connecting them with adjoining rails;

ballasting the railway switch;

packing track ballast; and connecting connection ducts for the railway switch and the safety devices.

38. A method for installing in railway tracks a railway switch capable of being transported in a preassembled state, comprising sleepers, a rail interspace region, a core region, a tongue device, actuating drives, and control means, wherein the actuating drives are hydraulic actuators, hydraulic lines for connection of the actuating drives are elastically fixed to the sleepers, and the actuating drives are connected to movable switch parts in a manner pivotable about an axis extending in a longitudinal direction of rails with elastic connection elements and crowned bearings being interposed, comprising the steps of completely preassembling the railway switch in functional units;

transferring the switch onto a transport vehicle to an installation site;

lowering the tongue region, the rail interspace region and, the core region including preassembled sleepers, the movable switch parts, and safety devices on the installation site in the preassembled state, and connecting them with adjoining rails;

ballasting the railway switch;

packing track ballast; and connecting connection ducts for the railway switch and the safety devices.

39. A method according to claim 37, wherein the core region or the rail interspace region, for transport purposes, is tilted out of a rail running plane and transported in tilted state.

40. A method according to claim 37, wherein the core region and the rail interspace region, for transport purposes, are both tilted out of a rail running plane and transported in tilted state.

41. A method according to claim 38, wherein the core region or the rail interspace region, for transport purposes, is tilted out of a rail running plane and transported in tilted state.

42. A method according to claim 38, wherein the core region and the rail interspace region, for transport purposes, are both tilted out of a rail running plane and transported in tilted state.

43. A method according to claim 39, wherein the rail interspace region or the core region, after tilting, is lowered in the vertical direction and connected with the tongue device.

44. A method according to claim 40, wherein the rail interspace region and the core region, after tilting, are both towered in the vertical direction and connected with the tongue device.

45. A method according to claim 41, wherein the rail interspace region or the core region, after tilting, is lowered in the vertical direction and connected with the tongue device.

46. A method according to claim 42, wherein the rail interspace region and the core region, after tilting, are both lowered in the vertical direction and connected with the tongue device.

* * * * *